US010390568B2

(12) United States Patent
Charles

(10) Patent No.: US 10,390,568 B2
(45) Date of Patent: Aug. 27, 2019

(54) FOOTWEAR ARTICLE PROVIDED WITH MEANS FOR HOLDING OR ATTACHING AN OBJECT ON SAID ARTICLE

(71) Applicant: FEETKIT, Paris (FR)

(72) Inventor: Frédéric Charles, Paris (FR)

(73) Assignee: FEETKIT, Paris (FR)

( * ) Notice: Subject to any disclaimer, the term of this patent is extended or adjusted under 35 U.S.C. 154(b) by 241 days.

(21) Appl. No.: 15/529,074

(22) PCT Filed: Sep. 24, 2015

(86) PCT No.: PCT/FR2015/000188
§ 371 (c)(1),
(2) Date: May 23, 2017

(87) PCT Pub. No.: WO2016/083677
PCT Pub. Date: Jun. 2, 2016

(65) Prior Publication Data

US 2017/0258145 A1 Sep. 14, 2017

(30) Foreign Application Priority Data

Nov. 26, 2014 (FR) ..... 14 02677
Nov. 28, 2014 (FR) ..... 14 02711

(51) Int. Cl.
*A41B 11/00* (2006.01)
*A41D 27/20* (2006.01)
*A41B 11/04* (2006.01)

(52) U.S. Cl.
CPC ..... *A41B 11/006* (2013.01); *A41B 11/04* (2013.01); *A41D 27/205* (2013.01)

(58) Field of Classification Search
CPC ..... A41B 1/006; A41B 11/04; A41B 11/00; A41D 27/205; A63B 71/12
USPC ..... 2/239
See application file for complete search history.

(56) References Cited

U.S. PATENT DOCUMENTS 5,027,440 A * 7/1991 Morris ..... A41B 11/006 2/239
5,625,904 A * 5/1997 Kline ..... A41B 11/006 2/239
5,836,019 A * 11/1998 McCafferty ..... A41B 11/006 2/239
D696,507 S * 12/2013 Tharp ..... D2/857
2007/0170216 A1 7/2007 Davis
2011/0289656 A1 12/2011 Witte
2011/0296588 A1 12/2011 Cummings

FOREIGN PATENT DOCUMENTS

FR 2 363 292 A1 3/1978
WO 2010/091468 A1 8/2010
WO 2010/140177 A1 12/2010

* cited by examiner

*Primary Examiner* — Gloria M Hale
(74) *Attorney, Agent, or Firm* — Im IP Law; C. Andrew Im; Chai Im

(57) ABSTRACT

A footwear article provided with a housing to removably hold or attach an object. The housing is arranged to minimize the inconvenience caused by the presence of the object in the housing when the housing of the footwear article is used on the foot, ankle or leg of a user. The longitudinal median axis of the object and/or the housing is located on the rear area of the inside or on the front area of the outside of the ankle/footwear article. The housing provides a storage space for an object such as a Smartphone.

19 Claims, 6 Drawing Sheets

FOOTWEAR ARTICLE PROVIDED WITH MEANS FOR HOLDING OR ATTACHING AN OBJECT ON SAID ARTICLE

RELATED APPLICATIONS

This application is a § 371 application from PCT/FR2015/000188 filed Sep. 24, 2015, which claims priority from French Patent Application No. 14 02677 filed Nov. 26, 2014 and No. 14 02711 filed Nov. 28, 2014, each of which is incorporated herein by reference in its entirety

FIELD OF THE INVENTION

This invention relates to the sector of socks and stockings.

The invention relates to a footwear article such as a sock or a stocking, provided with at least one set of means for holding or removably attaching an object, such as a pocket, in which set of means/in which pocket an object or a device such as a smartphone or other electronic device for receiving and/or transmitting electromagnetic waves, possibly an accessory of the device or a peripheral of the device, may be placed or inserted.

BACKGROUND OF THE INVENTION

Such socks or stockings, for example provided with at least one pocket, already exist (FR 2363292, PCT WO2010/14177), and in particular allow an object to be housed in at least one pocket, on the inside or outside of the sock or stocking, with or without a closure system.

However, these socks or stockings of known type do not specifically take account of the anatomy of the leg, the foot and the ankle, which are particularly sensitive especially in the area of the tibia bone, the fibula bone and in the area of the Achilles tendon and the tendon of the tibialis anterior muscle. A sock or a stocking comprising said means for holding or removably attaching an object, or a pocket, which are/is located just anywhere on the sock or stocking does not ensure a satisfactory level of comfort, since the object may be in excessively direct contact with the most sensitive areas of the foot, ankle and leg once the sock or stocking has been completely pulled on and positioned on the foot, ankle and leg of a user and the object has been fully inserted and centered in said means or pocket. The level of discomfort is moreover potentially all the greater:

- the greater the size and/or weight of the object (or the contents of the pocket). This is particularly the case for a smartphone or an electronic device for receiving and/or transmitting electromagnetic waves, possibly an accessory of the device or a peripheral of the device;
- the lower the height of the sock or stocking (such as a crew sock or stocking that reaches to below the triceps surae muscle of the calf); in this case the bottom/base of the object or pocket is close to the two malleoli;
- the greater the height of the sock or stocking (for example, a mid-calf sock or stocking that reaches up to the triceps surae muscle of the calf) and the sock or stocking tends to fall down on the foot and the malleoli of the ankle.

OBJECT AND SUMMARY OF THE INVENTION

The present invention is a footwear article such as a sock or a stocking, provided with at least one set of means for holding or removably attaching an object (comprising, for example, at least one pocket), on the inside or outside of the sock or stocking, in or from which means an object or device may be inserted or removed. The invention is characterized in that said means or said pocket are/is adapted and placed on the sock or stocking in such a way that they/it take(s) account of the anatomy of the region of the leg and the ankle so as to greatly limit the discomfort caused by the presence of the object or the device when the sock or stocking is worn by a user. By allowing said object to be held, ideally vertically, on the rear area of the inside of the leg and/or the ankle or on the front area of the outside of the leg and/or the ankle, the invention in fact makes it possible to limit the contact between the object and the areas of the leg and the ankle identified as particularly sensitive.

In the case in which said holding or removable attachment means comprise at least one pocket, the invention makes it possible to limit even more the contact between the pocket and its contents and the areas of the leg and the ankle identified as particularly sensitive (the tibia bone, the fibula bone, the Achilles tendon and the tendon of the tibialis anterior muscle) since the pocket containing the object is itself adapted and arranged with a longitudinal median axis of the pocket located in the rear area of the inside of the ankle or in the front area of the outside of the ankle (along with the median axis of the object contained in the pocket).

In particular, the invention makes it possible to greatly limit the discomfort in the area of the malleoli by allowing the base of said object, with the latter fully inserted and centered in said means, or the pocket and its contents, to slide, if necessary, on the correct side of the malleoli (towards the front of the outer malleolus of the fibula or towards the rear of the inner malleolus of the tibia) if the sock or stocking, and hence said means and the object or the pocket and its contents, should fall down on the leg.

The invention also makes it possible for said means or the pocket to be compact in the sock or stocking and to preserve the aesthetic appearance of the sock or stocking by limiting the use of materials which are too thick in the area of said means or the pocket. While such thick materials make it possible to relieve the discomfort of the object and said means or the pocket and its contents, they have a detrimental effect on the compactness of said means or pocket and on the appearance of the sock or stocking. Since the invention makes it possible to greatly reduce the discomfort caused by the object and said means or by the pocket and its contents, it therefore makes it possible to limit the use of these potentially bulky and unattractive materials.

According to particular embodiments of the invention:

- said holding or removable attachment means comprise at least one pocket, in which the pocket itself may be located in the rear area of the inside of the ankle or in the front area of the outside of the ankle;
- said means or the pocket are/is dimensioned to receive an object such as a smartphone or other electronic device for receiving and/or transmitting electromagnetic waves, possibly a peripheral of the device or an accessory of the device;
- said means or the pocket are/is of generally square or rectangular shape;
- said means or the pocket may have means for closing them;
- said means or the pocket may be on the inside or the outside of the sock or the stocking;
- said means or the pocket may be partially or fully integral with the sock or the stocking;
- the two socks or stockings for the left foot and for the right foot may be totally identical and interchangeable if the longitudinal median axis of said means or of the pocket is more particularly placed equidistant from the two malleoli;

at least two sets of holding or removable attachment means, or two pockets, may be provided on/in the sock or the stocking;

the top of said means or pocket may lie just under an elasticated strip at the top of the sock or stocking;

the sock or the stocking as well as said means or the pocket may have complementary means for improving the support for the object or the contents of the pocket (such as, for example, an oversized elasticated strip at the top of the sock and/or for example, an additional elasticated strip positioned under the bottom of the object and/or said means or under the bottom of the pocket and its contents);

all or part of said means or the pocket may be made from anti-wave material(s) for shielding against electromagnetic waves.

BRIEF DESCRIPTION OF THE DRAWINGS

The invention will be better understood with reference to the detailed description of the attached drawings showing the invention according to the various embodiments as follows.

DETAILED DESCRIPTION OF THE EMBODIMENTS

Figure 9:
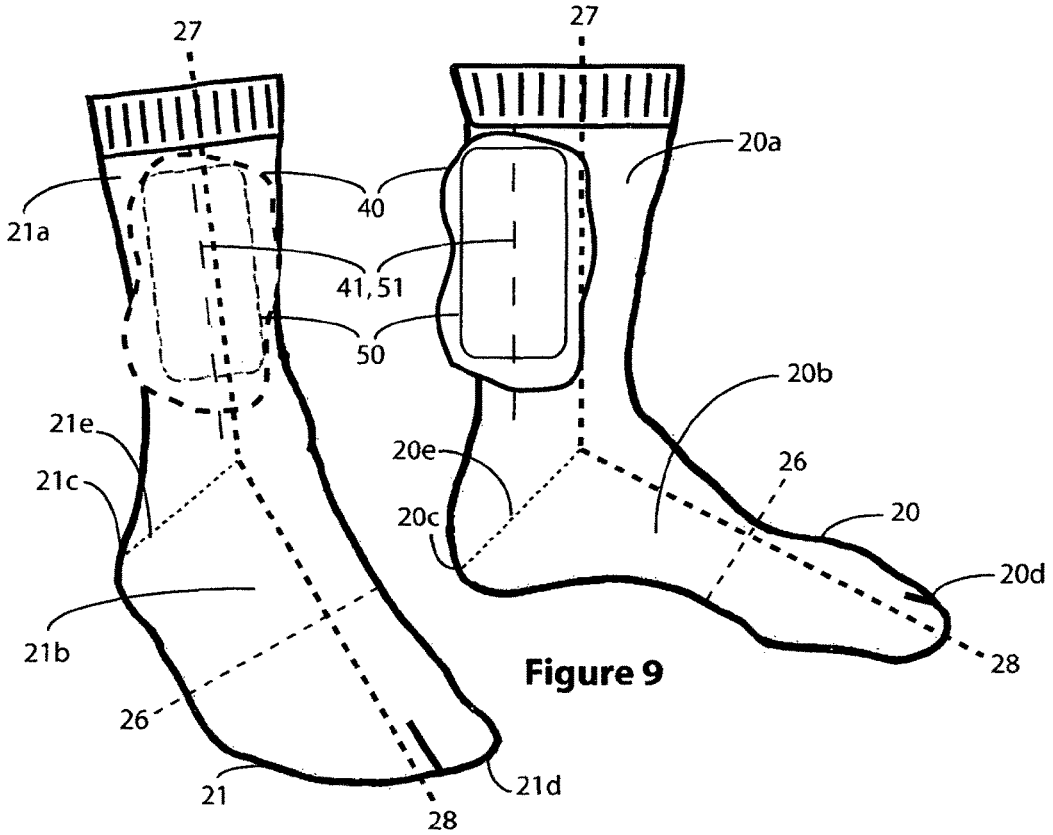
FIGS. 9 and 10 show the invention with a sock or a stocking for the left foot, provided with said means arranged on the outside face of the sock or stocking, allowing said object, once fully inserted in said means, to be located in the rear right 90° quarter of the sock or stocking, and a sock or a stocking for the right foot, provided with said means arranged on the inside face of the sock or stocking, allowing said object, once fully inserted in said means, to be located in the front right 90° quarter of the sock or stocking.
Figure 10:
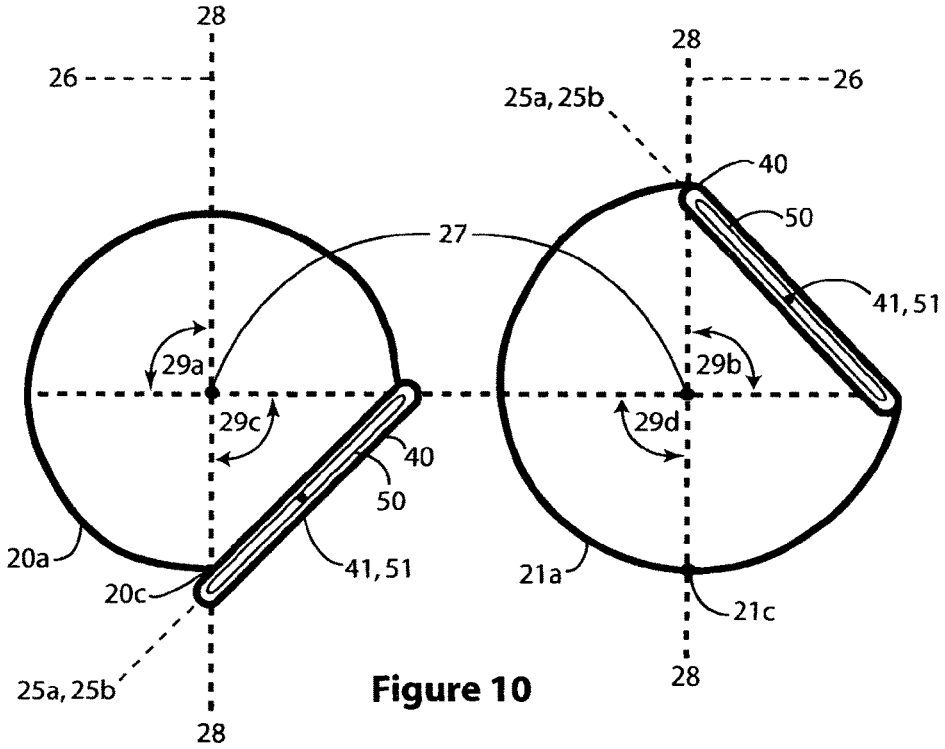

With reference to these drawings and as shown first of all by FIGS. 9 and 10, the invention consists of a footwear article (20, 21), made of deformable flexible material, such as a sock or a stocking, comprising first (20*a*, 21*a*) and second (20*b*, 21*b*) sleeves, which are substantially cylindrical, arranged at an angle of between approximately 90° and 135° with respect to each other, the area of joining (20*e*, 21*e*) between the two sleeves corresponding to the heel (20*c*, 21*c*), the first sleeve (20*a*, 21*a*) being open at its end opposite the heel (20*c*, 21*c*) and the second sleeve (20*b*, 21*b*) being closed at its end opposite the heel (20*c*, 21*c*) to receive the toes (20*d*, 21*d*) of a user, characterized in that it comprises holding, supporting, housing, etc. means (40) for an object (50), at least one dimension of which is substantially less than at least one other, and in that for at least half of them/it, said means (40) and/or the object (50) in use are/is located on the first "open" sleeve (20*a*, 21*a*), either in the rear left (29*d*) or front right (29*b*) 90° quarter for a footwear article (21) for the right foot (17), or in the rear right (29*c*) or front left (29*a*) 90° quarter for a footwear article (20) for the left foot (16), seen in cross section in a plane transverse to the longitudinal axis (27) of said first sleeve (20*a*, 21*a*) relative to the longitudinal axis (28) of the second "closed" sleeve (20*b*, 21*b*).

"Front" and "rear" are defined with respect to a median line (26) orthogonal to the longitudinal axis (28) of the second closed sleeve (20*b*, 21*b*), with the "rear" zone corresponding to the zone containing said heel (20*c*, 21*c*) and the "front" zone corresponding to the zone containing said toes (20*d*, 21*d*).

The term "footwear article (20, 21)" means any garment covering all or part of the foot (16, 17), the ankle and the leg (16*b*, 17*b*), such as a sock, a stocking, or tights.

The term "holding, supporting, housing, etc. means (40) for an object (50)" means any means making it possible to hold an object (50) horizontally and/or vertically with respect to a plane parallel to the longitudinal axis (27) of said first sleeve (20*a*, 21*a*) or to the longitudinal axis of the leg (16*c*, 17*c*). Said means (40) may in particular allow removable attachment of the object (50). Said means comprise for example:

a pocket (30) provided with at least one opening, preferably at the top, through which opening the object (50) may be inserted or removed;

one or more strip(s) of deformable flexible material, which is/are preferably horizontal or vertical and preferably elasticated, arranged on the footwear article (20, 21) in such a way that it/they form(s) all or part of a closed cylinder, in or from which cylinder the object (50) may be inserted or removed;

one or more strip(s) of deformable flexible material, which is/are preferably horizontal or vertical and preferably elasticated, forming at least two flaps for encircling the object (50), the flaps being provided with a closure system such as, for example, mechanical adhesive elements such as hook and loop.

The term "object (50) in use" means an object (50) which is fully inserted and centered in the holding, supporting, housing, etc. means (40).

Advantageously, and as shown in FIG. 10, said holding, supporting, housing, etc. means (40), and/or said object (50) in use, are/is located in such a way that:

either the tangent (25*a*) to the point of contact with the surface of the footwear article (20, 21); or the plane (25*b*) of said means (40) or said object (50) in use, make(s) an angle of between 0° and 75° with the longitudinal axis (28) of the second closed sleeve (20*b*, 21*b*).

Figure 11:
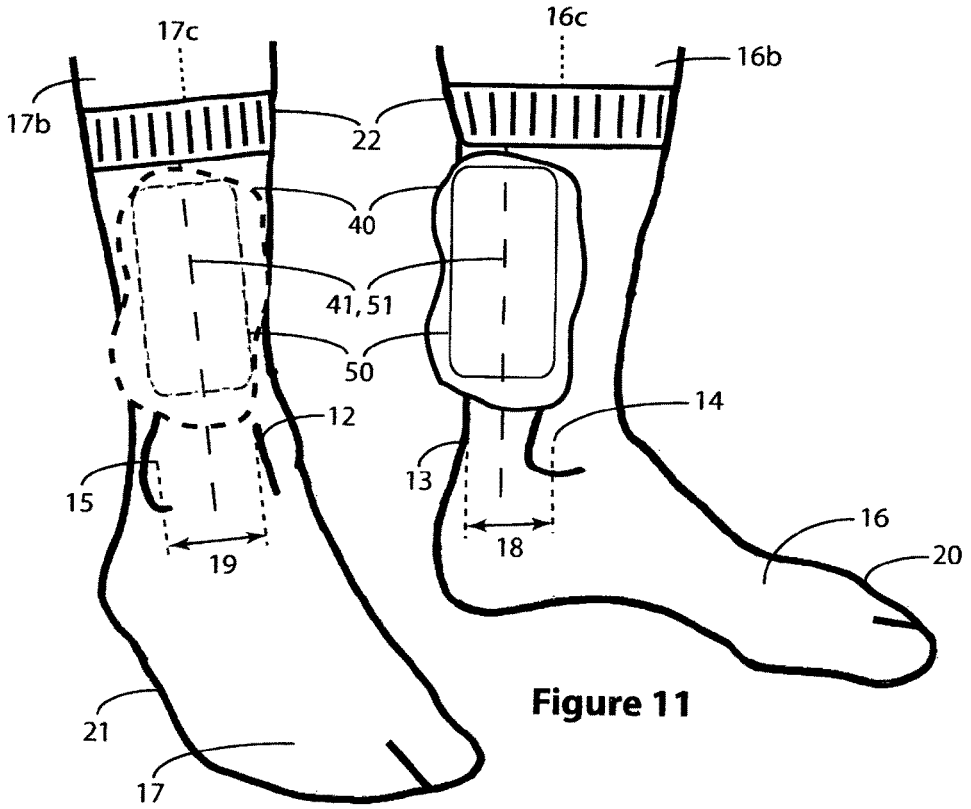
FIGS. 11 and 12 show the same elements as FIGS. 9 and 10, the sock or the stocking being completely pulled on and positioned on the foot, the ankle and the leg of a user. They show the invention with a sock or a stocking for the left foot, provided with said means arranged on the outside face of the sock or stocking, allowing said object, once fully inserted in said means, to be located in the inner rear position on the leg and/or the ankle, and a sock or a stocking for the right foot, provided with said means arranged on the inside face of the sock or stocking, allowing said object, once fully inserted in said means, to be located in the outer front position on the leg and/or the ankle.
Figure 12:
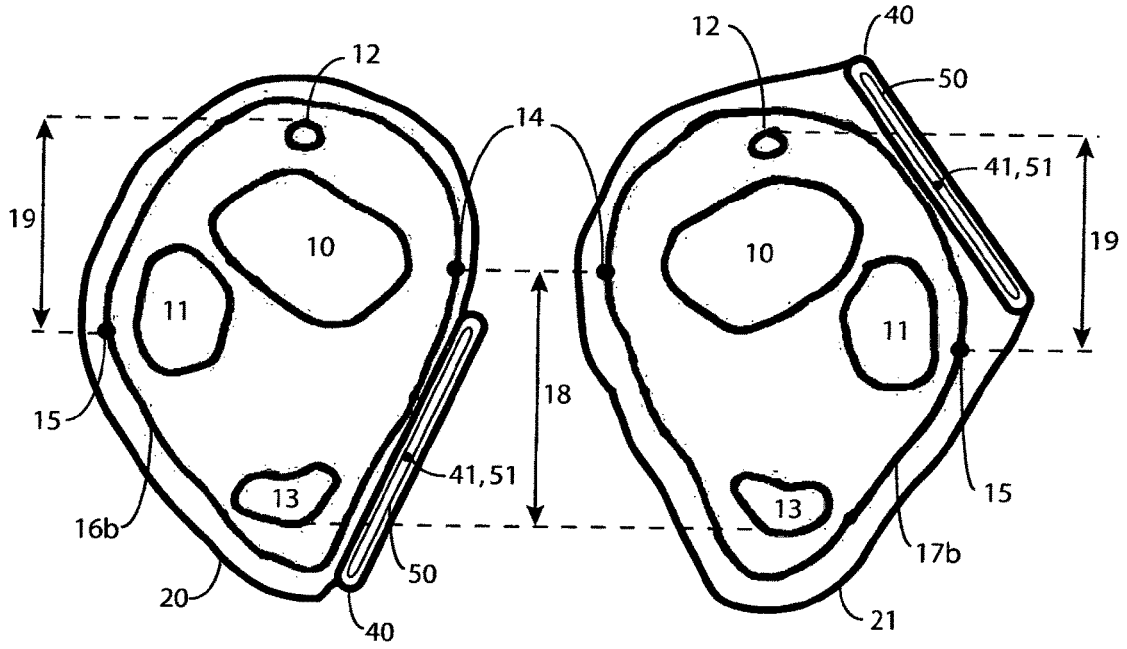

As shown in FIGS. 11 and 12, the invention consists of a footwear article (20, 21) made of deformable flexible material, such as a sock or a stocking, comprising first (20*a*, 21*a*) and second (20*b*, 21*b*) sleeves, which are substantially cylindrical, arranged at an angle of between approximately 90° and 135° with respect to each other, the area of joining (20*e*, 21*e*) between the two sleeves corresponding to the heel (20*c*, 21*c*), the first sleeve (20*a*, 21*a*) being open at its end opposite the heel (20*c*, 21*c*) and the second sleeve (20*b*, 21*b*) being closed at its end opposite the heel (20*c*, 21*c*) to receive the toes (20*d*, 21*d*) of a user, the footwear article (20, 21) being in use on a leg (16, 17*b*) of the user, said leg (16*b*, 17*b*) comprising:

a malleolus of the tibia (14) located at the lower end of the tibia bone on the inside of the leg (16*b*, 17*b*) and the foot (16, 17);

a malleolus of the fibula (15) located at the lower end of the fibula bone on the outside of the leg (16*b*, 17*b*) and the foot (16, 17);

an Achilles tendon (13) located on the rear part of the leg (16*b*, 17*b*) and the foot (16, 17);

a tendon of the tibialis anterior muscle (12) on the front part of the leg (16*b*, 17*b*) and the foot (16, 17), the footwear article (20, 21) being characterized in that it comprises holding, supporting, housing, etc. means (40) for an object (50), at least one dimension of which is substantially less than at least one other, said means (40) being arranged on the footwear article (20, 21) in such a way that said means (40) and/or said object (50) in use are/is located in at least one of the following two positions:

a rear part of the inside (18) of the leg (16*b*, 17*b*) and/or of the ankle: the longitudinal median axis (41) of said means (40) and/or the longitudinal median axis (51) of said object (50) in use being located between the center of the malleolus of the tibia (14) and the Achilles tendon (13);

a front part of the outside (19) of the leg (16*b*, 17*b*) and/or of the ankle: the longitudinal median axis (41) of said means (40) and/or the longitudinal median axis (51) of said object (50) in use being located between the center of the malleolus of the fibula (15) and the tendon of the tibialis anterior muscle (12).

The term "footwear article (20, 21) in use on a leg (16*b*, 17*b*) of a user" means a footwear article (20, 21) which is completely pulled on and positioned on the foot, (16, 17), the ankle and the leg (16*b*, 17*b*) of a user.

According to one embodiment of the invention, said holding, supporting, housing, etc. means (40) comprise at least one pocket (30) having at least one opening, the pocket (30) being arranged in a plane quasi-parallel to the longitudinal axis (27) of the first sleeve (20*a*, 21*a*).

Figure 1:
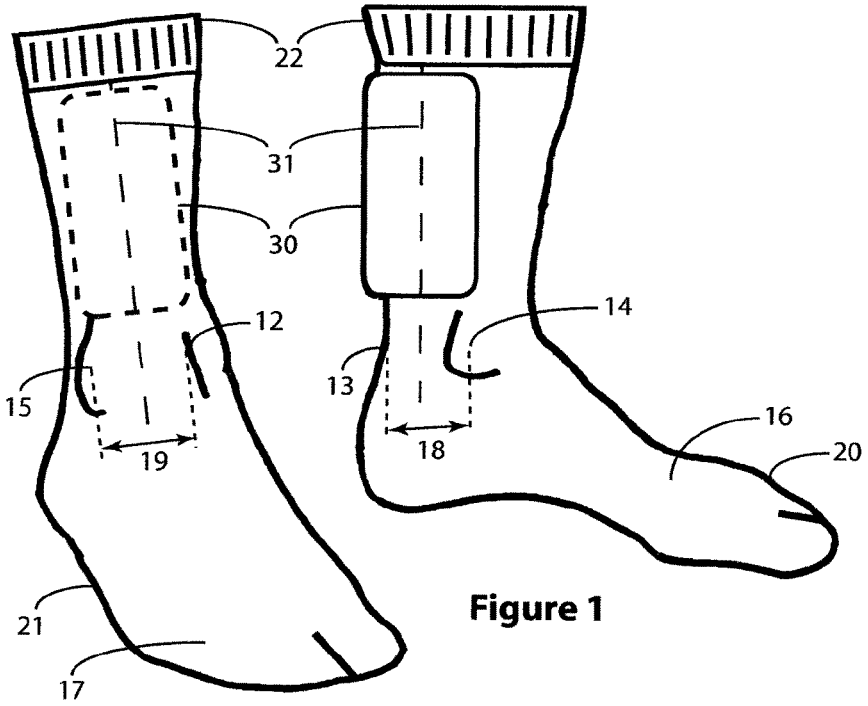
FIG. 1 shows the invention with said means taking the form of a pocket. It shows a sock or a stocking for the left foot, provided with a pocket on the outside of the sock or the stocking, located in the inner rear position on the leg and/or the ankle, and a sock or a stocking for the right foot, provided with a pocket on the inside of the sock or the stocking, located in the outer front position on the leg and/or the ankle.
Figure 2:
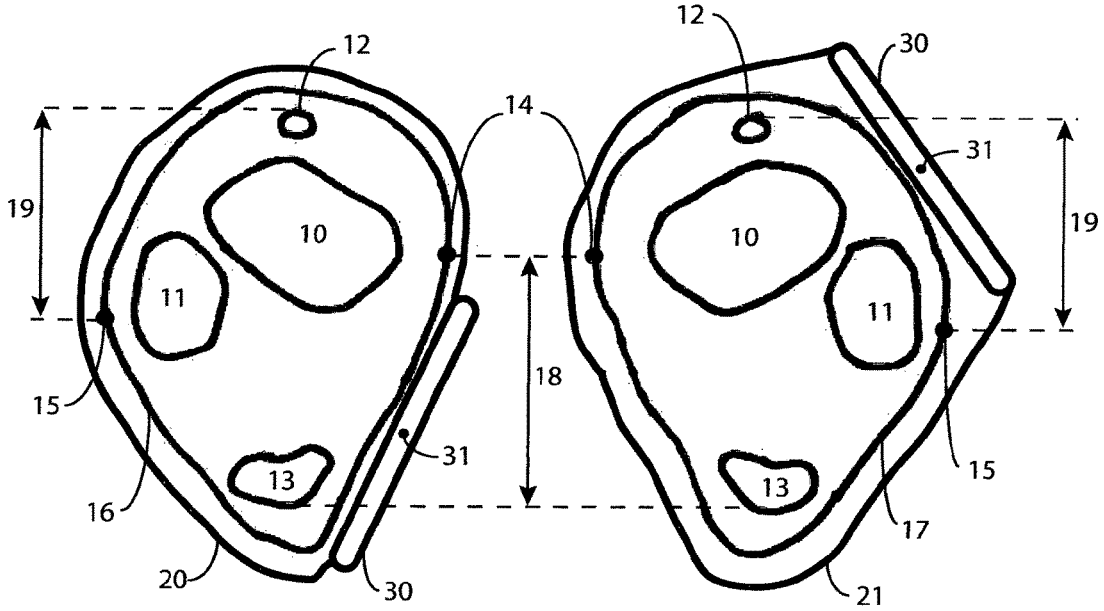
FIG. 2 shows the same elements as FIG. 1 with a view in cross section taken at the ankle.

According to one embodiment of the invention shown in FIGS. 1 and 2, the invention consists of a footwear article such as a sock or a stocking (20, 21) in use on a leg (16*b*, 17*b*) of a user, provided with at least one pocket (30) in or from which the object or the device may be inserted or removed. The pocket (30) is placed on the sock (20, 21) in such a way that it is located in one of the following two positions:

on the rear part of the inside of the leg and/or of the ankle (18): the longitudinal median axis (31) of the pocket (30) is located between the center of the malleolus of the tibia (14) and the Achilles tendon (13), on the front part of the outside of the leg and/or of the ankle (19): the longitudinal median axis (31) of the pocket (30) is located between the center of the malleolus of the fibula (15) and the tendon of the tibialis anterior muscle (12).

Whatever the height of the sock or the stocking (for example, crew or mid-calf) and regardless of the size of the object (50) and of said holding, supporting, housing, etc. means (40) (or of the pocket (30) and its contents) contemplated, this makes it possible to greatly limit the discomfort by limiting the contact between the object (50) and said holding means (40), or the pocket (30) and its contents, and the sensitive areas of the tibia bone (10), the fibula bone (11) (and in particular the two lower ends thereof, the two malleoli (14, 15)), as well as in the area of the tendon of the tibialis anterior muscle (12) and the Achilles tendon (13).

This makes it possible in particular for the base of the object (50) and of said holding, supporting, housing, etc. means (40), or of the pocket (30) and its contents, to be able to slide on the correct side of the malleolus (on the back of the malleolus of the tibia (14) or on the front of the malleolus of the fibula (15)) in the case where the sock or the stocking (20, 21) and, hence, the object (50) and said support means (40) or the pocket (30) and its contents should fall down a little on the foot (16, 17). An object (50) and said means (40) or a pocket (30) and its contents that are incorrectly positioned on the sock or stocking (20, 21) and that happen to fall down on the foot on the front part of the inner malleolus of the tibia (14) or the rear part of the outer malleolus of the fibula (15) would, by contrast, be a source of discomfort.

This makes it possible to greatly limit the discomfort independently of any particular means which could otherwise be used to limit the discomfort (padding of all or part of said means (40) or of the pocket (30), use of thick material to make said means (40) or the pocket (30), etc.), with the risk that said means (40) or the pocket (30) would be thicker and therefore bulkier and less aesthetically pleasing.

The left sock or stocking (20) for the left foot (16) should, a priori, be distinguished from the right sock or stocking (21) for the right foot (17) when the two positions (18, 19) on the same leg (16*b*, 17*b*) and/or ankle as defined by the invention are not a priori symmetrical, or in other words, when said 90° quarters (29*a*, 29*c*) of a left sock or stocking (20) for the left foot (16) and said 90° quarters (29*b*, 29*d*) of a right sock or stocking (21) for the right foot (17) are not superimposable, seen in section in a plane transverse to the longitudinal axis (27) of said first sleeve (20*a*, 21*a*). A left sock or stocking (20) for the left foot (16) in use on the right foot (17)/right leg (17*b*) or a right sock or stocking (21) for the right foot (17) in use on the left foot (16)/left leg (16*b*) would in fact be a source of discomfort, a priori, once the object (50) is in use in said holding, supporting, housing, etc. means (40).

According to another embodiment of the invention, the footwear article (20, 21) comprises a distinctive element enabling a user to identify whether said footwear article (20, 21) is a footwear article (20) for the left foot (16) or a footwear article (21) for the right foot (17). A label which is red and/or marked "G" or "L" may, for example, be arranged on a left sock or stocking (20) for the left foot (16) and a label which is green and/or marked "D" or "R" may, for example, be arranged on a right sock or stocking (21) for the right foot (17).

The invention provides that said object (50) (or the contents of the pocket) may thus be placed with a lesser degree of discomfort in two different positions (18, 19) on the same leg (16*b*, 17*b*) and/or ankle, or in two different 90° quarters (a rear 90° quarter (29*c*, 29*d*) and a front 90° quarter (29*a*, 29*b*)) of the same sock or stocking (20, 21).

According to another embodiment of the invention, the pocket (30) is generally square or rectangular in shape.

Preferably, said holding, supporting, housing, etc. means (40) or the pocket (30) are/is dimensioned so as to be able to house and hold therein a smartphone or other electronic device for receiving and/or transmitting electromagnetic waves, possibly an accessory of the device or a peripheral of the device, in order to better receive and hold the device, its accessory or peripheral vertically in the sock or the stocking (20, 21). The sock or stocking (20, 21) must be of sufficient height to accommodate said means (40) or the pocket (30) adapted to their/its contents. In the case, for example, of a flat rectangular smartphone, with a height of 10 to 15 cm and a width of 6 to 9 cm, said means (40) or the pocket (30) will, for example, be of almost identical dimensions, slightly greater than those of said smartphone, with a height of approximately 10 to 15 cm and a width of approximately 6 to 9 cm.

According to another embodiment, the pocket (30) is provided with means for temporarily closing its opening. Advantageously, in the case of a pocket (30) having an opening at the top, the top of the pocket (30) is provided with temporary closure means such as, for example, an elasticated opening for the pocket, a buttonhole flap designed to interact with a button attached to the pocket, a zipper, an adhesive tape closure.

According to another embodiment of the invention, said holding, supporting, housing, etc. means (40) or the pocket (30) are/is located on the outside of the sock or stocking (20, 21).

According to another embodiment of the invention, said holding, supporting, housing, etc. means (40) or the pocket (30) are/is located on the inside of the sock or stocking (20, 21).

Advantageously, said holding, supporting, housing, etc. means (40) are either fitted on the inside face or on the outside face of the footwear article (20, 21) or are integral with the footwear article (20, 21).

Figure 3:
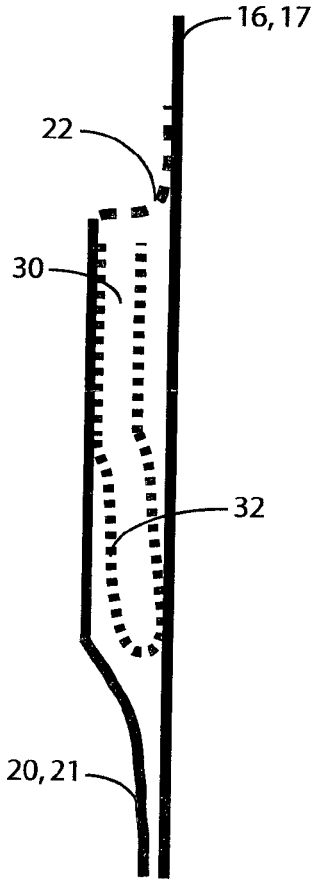
FIG. 3 shows another embodiment of the invention with a pocket which is partially integral with the sock or the stocking.

According to another embodiment of the invention shown in FIG. 3, the pocket (30), which is at least partially joined to said footwear article (20, 21) along its side edges, is partially integral with said footwear article (20, 21), with its lower part (32) being movable.

Figure 4A:
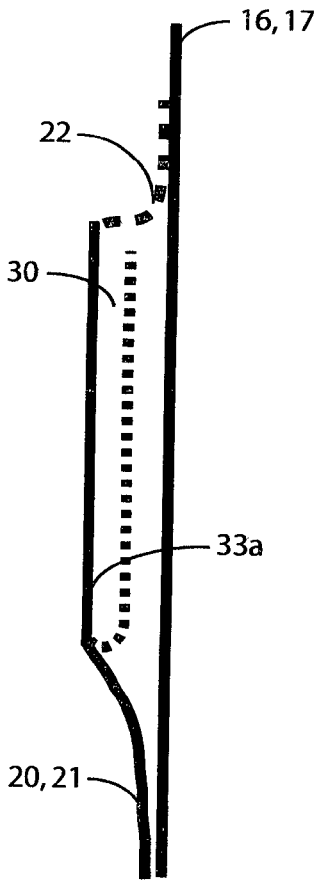
FIGS. 4A and 4B show two other embodiments of the invention with a pocket which is fully integral with the sock or the stocking.
Figure 4B:
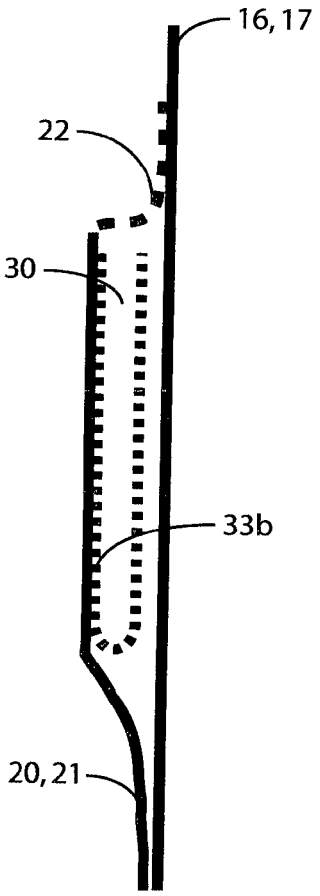

According to another embodiment of the invention shown in FIGS. 4*a* and 4*b*, the pocket (30), which is at least partially joined to said footwear article (20, 21) along its side edges and at least at its base, is fully integral with said footwear article (20, 21), with its lower part (33*a*, 33*b*) being integral with said footwear article (20, 21).

Figure 5:
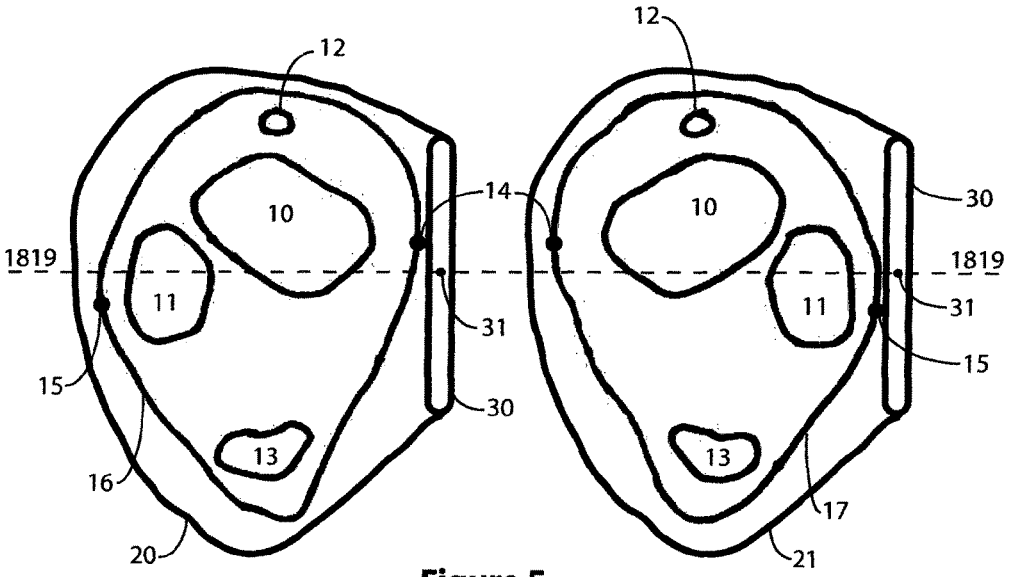
FIG. 5 shows another embodiment of the invention with two identical socks or stockings comprising a pocket more precisely centered on the rear part of the malleolus of the tibia or on the front part of the malleolus of the fibula, equidistant from the center of the two malleoli. The pocket shown is on the inside of the sock or the stocking.

According to another embodiment of the invention shown in FIG. 5, the longitudinal median axis (41) of said holding, supporting, housing, etc. means (40) is located in the area of the first sleeve (20*a*, 21*a*) which, when the article is in use on a leg (16*b*, 17*b*) of a user, corresponds to a front part of the malleolus of the fibula or a rear part of the malleolus of the tibia, equidistant (1819) from the centers of the two malleoli (14, 15).

The longitudinal median axis (41, 31) of said holding means (40) or of the pocket (30) is located more precisely in the front part of the malleolus of the fibula (15) or in the rear part of the malleolus of the tibia (14), equidistant (1819) from the centers of the two malleoli (14, 15). This position (1819) being symmetrical for the same left foot (16) or for the same right foot (17), the left sock or stocking (20) for the left foot (16) may then be identical to the right sock or stocking (21) for the right foot (17). In this case, it is not necessary to differentiate between the sock or stocking for the left foot (20) and the sock or stocking for the right foot (21), which may be interchangeable. In the case of a pocket (30), the bottom of the pocket (30) in this case is preferably movable and not integral (32) with the sock or the stocking, in order to facilitate the sliding of the object or the device on the correct side of the malleolus if necessary (for example if the sock or stocking should fall down on the foot). In the case of FIG. 5, the two socks or stockings (20, 21) are perfectly identical, having the same inside pocket, and are interchangeable.

Figure 6:
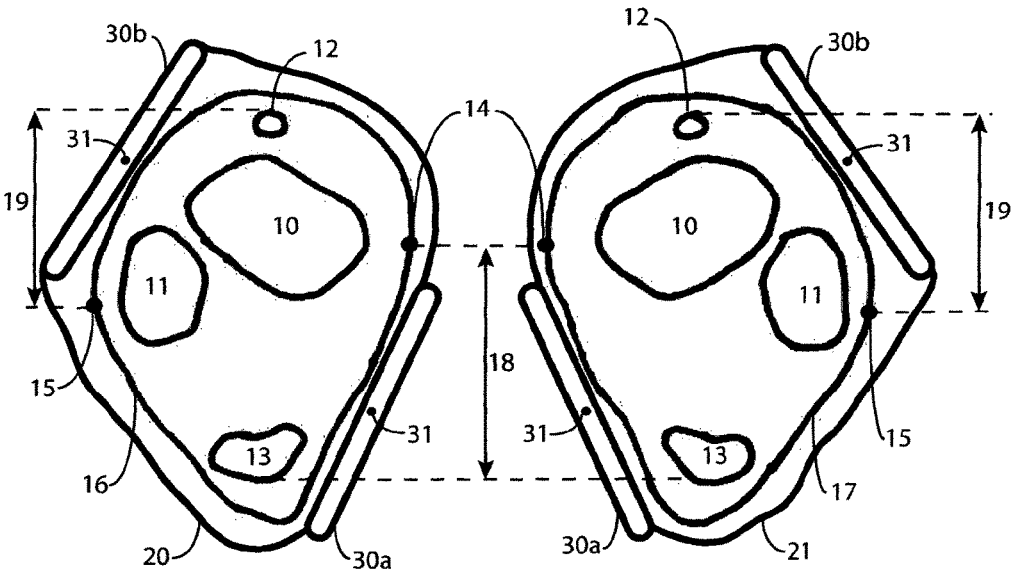
FIG. 6 shows another embodiment of the invention: the same configuration as FIG. 2, but with two pockets on the sock or the stocking. The pocket in the inner rear position on the two legs and/or ankles is on the outside of the sock or the stocking and the pocket in the outer front position on the two legs and/or ankles is on the inside of the sock or the stocking.

According to another embodiment of the invention shown in FIG. 6, the footwear article (20, 21) comprises at least two sets of holding, supporting, housing, etc. means (40) or two pockets (30*a*, 30*b*), which are identical or different, with a first set of holding, supporting, housing, etc. means (40) or a pocket (30*a*) placed in the rear position on the inside of the leg and/or the ankle (18) and the other set of holding, supporting, housing, etc. means or the other pocket (30*b*) placed in the front position on the outside of the leg and/or the ankle (19).

Figure 7:
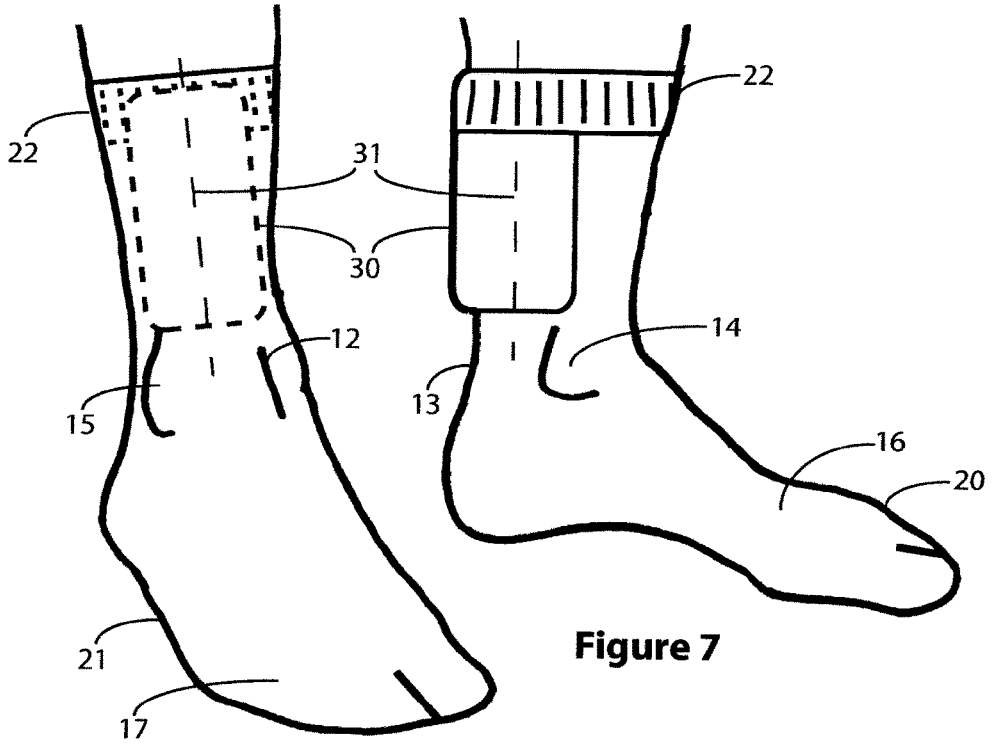
FIG. 7 shows another embodiment of the invention: the same configuration as FIG. 1, but with the elasticated strip at the top of the sock or the stocking folded down over the top of the pocket.

According to another embodiment of the invention shown in FIG. 7, the top of the holding, supporting, housing, etc. means (40) or the pocket (30) lies just under an elasticated strip or the like (22) at the top of the sock or stocking (20, 21) or of the open area of the first sleeve (20*a*, 21*a*), said elasticated strip (22) being smaller in diameter than said first sleeve (20*a*, 21*a*). In the case where said means (40) or the pocket (30) comprise an opening at the top, it is then possible to fold the top of the sock or the stocking over the top of said means (40) or the pocket (30) to close off the opening of said means (40) or of the pocket (30), irrespective of any system for closing said means (40) or the pocket (30) which could otherwise be provided to secure the closure. The elasticated strip (22) is folded down on the inside of the sock or stocking if said means (40) or the pocket (30) are/is on the inside of the sock or stocking and is folded down on the outside of the sock or stocking if said means (40) or the pocket (30) are/is on the outside of the sock or stocking.

According to another embodiment of the invention, the sock or stocking (20, 21) and said means (40) or the pocket (30) ensure and reinforce the support for the contents of the pocket.

Figure 8:
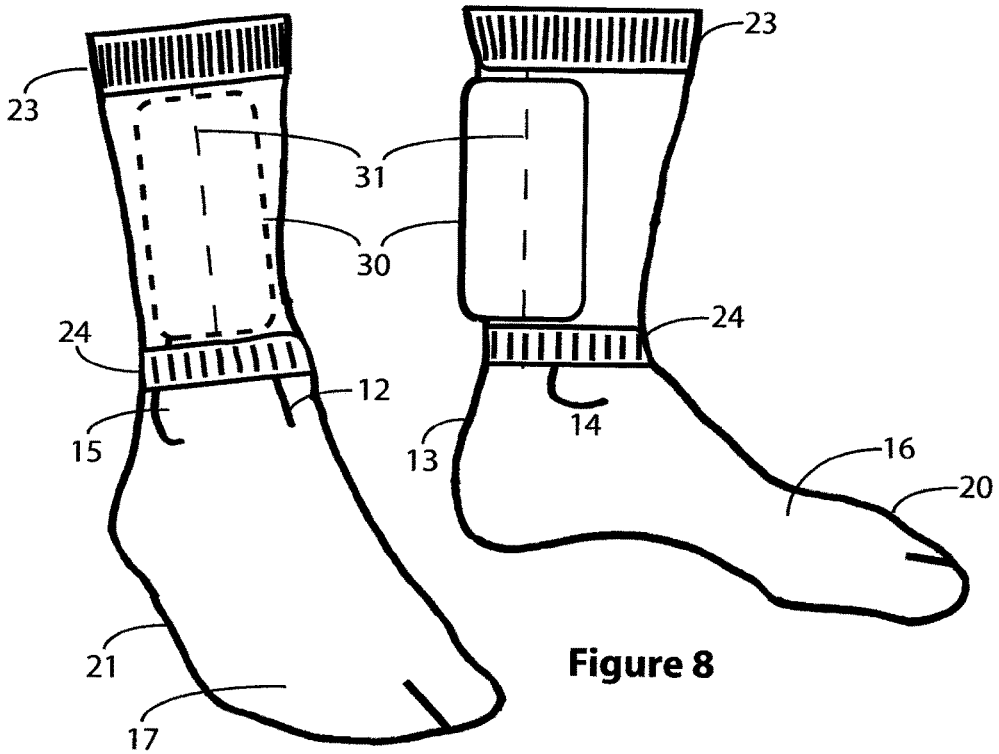
FIG. 8 shows another embodiment of the invention: the same configuration as FIG. 1, with a reinforced elasticated strip at the top of the sock or the stocking and an additional elasticated strip or the like located under the bottom of the pocket.

According to another embodiment of the invention shown in FIG. 8, the footwear article (20, 21) comprises an elasticated strip or the like (23) arranged on said footwear article (20, 21) above said holding, supporting, housing, etc. means (40), said strip (23) being reinforced to take account of the weight of said object (50) and being smaller in diameter than said first sleeve (20*a*, 21*a*).

The holding of said holding, supporting, housing, etc. means (40) and the object (50), or of the pocket (30) and its contents, provided by the sock or stocking (20, 21) is reinforced by an elasticated strip or the like (23) at the top of the sock or the stocking, which is oversized and reinforced to take account of the weight of the object (50) held in said means (40) or of the contents of the pocket (30).

Preferably, the elasticated strip or the like (23) is reinforced to take account of the weight of a smartphone or other electronic device for receiving and/or transmitting electromagnetic waves, possibly an accessory of the device or a peripheral of the device.

According to another embodiment of the invention shown in FIG. 8, the footwear article (20, 21) comprises an elasticated strip or the like (24), which is smaller in diameter than said first sleeve (20*a*, 21*a*) , said strip (24) being located in the area of the first sleeve (20*a*, 21*a*) which, when the article is in use on a leg (16*b*, 17*b*) of a user, is between the top of the two malleoli (14, 15) of said leg (16*b*, 17*b*) and the base of said holding, supporting, housing, etc. means (40) and/or the base of the object (50) in use.

The holding of said means (40) and the object (50), or of the pocket and its contents, provided by the sock or stocking (20, 21) is reinforced by an additional elasticated strip or the like (24) which is integral with the sock under the bottom of said means (40) or under the bottom of the pocket.

Preferably, the elasticated strip or the like (24) is dimensioned in such a way that the top of said strip (24) lies just at the base of said means (40) or the pocket (30), that the bottom of said strip (24) lies just above the malleoli (14, 15) and that the elastic power of said band (24) takes account of the weight of a smartphone or other electronic device for receiving and/or transmitting electromagnetic waves, possibly an accessory of the device or a peripheral of the device.

According to another embodiment of the invention, all or part of said holding, supporting, housing, etc. means (40) is made from an "anti-wave" material or a combination of "anti-wave" materials for shielding against electromagnetic waves.

According to another embodiment of the invention, the footwear article (20, 21) forms part of a pair of footwear articles (20, 21), composed of a footwear article (20) for the left foot (16) and a footwear article (21) for the right foot (17).

According to an ideal embodiment of the invention, the sock or stocking (20, 21) comprises a pocket (30) which is fully integral with the sock or stocking (20, 21). The pocket (30) is square/rectangular in shape and dimensioned so as to be able to house and hold therein a smartphone. The pocket (30) is arranged on the sock or stocking (20, 21), in the rear left 90° quarter (29*d*) for a sock or stocking (21) for the right foot (17) and in the rear right 90° quarter (29*c*) for a sock or stocking (20) for the left foot (16). The pocket is arranged on the sock or stocking (20, 21) in use in such a way that it is located on the rear part of the inside of the leg and/or the ankle (18) and more precisely in the middle of the area, in other words such that the longitudinal median axis of the pocket (31) is located in the middle of the segment defined by the center of the malleolus of the tibia (14) and the Achilles tendon (13). A label is arranged on the sock or stocking (20, 21), said label being red and marked "L" for a sock or stocking (20) for the left foot (16) or being green and marked "R" for a sock or stocking (21) for the right foot (17). The base of the pocket (30) is located above the malleolus of the tibia (14) when the sock (20, 21) is in use on the foot (16, 17) or the leg (16*b*, 17*b*) of a user. An elasticated strip (24) which is smaller in diameter than the first sleeve (20*a*, 21*a*) is arranged on the sock or stocking (20, 21) in use in such a way that said band (24) lies above the malleoli (14, 15), that the top of said strip (24) lies just at the base of the pocket (30) and that the bottom of said strip (24) lies just above the malleolus of the tibia (14). The sock or stocking (20, 21) further comprises an elasticated strip (23) at the very top of the first sleeve (20*a*, 21*a*). The elastic power of the two elasticated strips (23, 24) is reinforced in order to effectively support the weight of the smartphone. The footwear article (20, 21) moreover forms part of a pair of footwear articles (20, 21) composed of a footwear article (20) for the left foot (16) and a footwear article (21) for the right foot (17).

The embodiments of the invention presented above are not to be considered as limiting the invention:

- said means (40) or the pocket (30) may be of any constitution: they/it may be made of at least one material identical to those of which the sock or stocking (20, 21) is made. They/it may also be composed of different materials (more or less bulky, more or less comfortable, more or less elastic, more or less adherent to the skin and/or to the sock or stocking, more or less shielding electromagnetic waves, etc.);
- the sock or the stocking (20, 21) may contain other pockets in addition to said means (40), the pocket (30) or the two pockets (30*a*, 30*b*) as provided for by the invention. These additional pockets may be of any type, size and position on the sock or stocking (20, 21);
- said means (40) or the pocket (30) may provide means for increasing comfort (for example with the lower part or inner part of the pocket (30) padded or made of a thicker material).

The invention is particularly designed to provide a new storage location for smartphones and other electronic devices for receiving and/or transmitting electromagnetic waves, possibly peripherals of the device or accessories of the device. It makes it possible, if necessary, to keep mobile phones and other electronic devices for receiving and/or transmitting electromagnetic waves away from the most sensitive areas of the body, while being compact and easy to use and limiting the discomfort caused to the leg and ankle.

The invention claimed is:

1. A footwear article, made of deformable flexible material, comprising:

first and second sleeves, which are substantially cylindrical, arranged at an angle of between approximately 90° and 135° with respect to each other, an area of joining between the first and second sleeves corresponding to a heel, the first sleeve is open at an end opposite the heel and the second sleeve is closed at an end opposite the heel to receive toes of a user; and an object holder configured to hold at least half of an object which at least one dimension is less than at least one other dimension, on the first sleeve, either in a rear left or a front right 90° quarter for the footwear article for a right foot, or in a rear right or a front left 90° quarter for the footwear article for a left foot, in a cross section of a plane transverse to a longitudinal axis of the first sleeve relative to a longitudinal axis of the second sleeve.

2. The footwear article as claimed in claim 1, wherein the object holder is configured to hold the object such that the longitudinal axis of the second sleeve is at an angle of between 0° and 75° with either a tangent to a point of contact with a surface of the footwear article or a plane of the object.

3. A footwear article, made of deformable flexible material, comprising:

first and second sleeves, which are substantially cylindrical, arranged at an angle of between approximately 90° and 135° with respect to each other, an area of joining between the first and second sleeves corresponding to a heel, the first sleeve is open at an end opposite the heel and the second sleeve is closed at an end opposite the heel to receive toes of a user, the footwear article configured to be used on a leg of the user;

an object holder configured to hold an object which at least one dimension is less than at least one other, in at least one of the following two positions:

a rear part of an inside face of at least one of the user's leg and user's ankle, and wherein the longitudinal median axis of the object is located between a center of a malleolus of a tibia and an Achilles tendon of the user; and a front part of an outside face of at least one of the user's leg and user's ankle, and wherein the longitudinal median axis of the object is located between a center of a malleolus of a fibula and a tendon of a tibialis anterior muscle of the user.

4. The footwear article as claimed in claim 1, wherein the footwear article is in use on a leg of the user; and wherein the object holder is arranged on the footwear article to hold the object in at least one of the following two positions:

a rear part of an inside face of at least one of the user's leg and user's ankle, and wherein the longitudinal median axis of the object is located between a center of a malleolus of a tibia and an Achilles tendon of the user; and a front part of an outside face of at least one of the user's leg and user's ankle, and wherein the longitudinal median axis of the object is located between a center of a malleolus of a fibula and a tendon of a tibialis anterior muscle of the user.

5. The footwear article as claimed in claim 1, wherein the object holder is either fitted on an inside face or on an outside face of the footwear article, or is integral with the footwear article.

6. The footwear article as claimed in claim 1, wherein the object holder comprises at least one pocket having at least one opening, the pocket is arranged in a plane quasi-parallel to the longitudinal axis of the first sleeve.

7. The footwear article as claimed in claim 6, wherein the footwear article is configured to be used on a leg of the user; and wherein said at least one pocket is placed on the footwear article such that said at least one pocket is configured to be located in at least one of the following two positions:

a rear part of an inside face of at least one of the user's leg and user's ankle, and wherein a longitudinal median axis of the pocket is configured to be located between a center of a malleolus of a tibia and an Achilles tendon of the user; and a front part of an outside face of at least one of the user's leg and user's ankle, and wherein the longitudinal median axis of the pocket is configured to be located between a center of a malleolus of a fibula and a tendon of a tibialis anterior muscle of the user.

8. The footwear article as claimed in claim 6, wherein said at least one pocket is generally square or rectangular in shape.

9. The footwear article as claimed in claim 6, wherein said at least one pocket comprises a closure to temporarily close said at least one opening.

10. The footwear article as claimed in claim 6, wherein said at least one pocket is at least partially joined to the footwear article along its side edges thereof and is partially integral with the footwear article with a lower part of said at least one pocket being movable.

11. The footwear article as claimed in claim 6, wherein the said at least one pocket is at least partially joined to the footwear article along its side edges thereof and at least at a base of said pocket, is fully integral the footwear article with lower part of said at least one pocket being integral with the footwear article.

12. The footwear article as claimed in claim 3, wherein the longitudinal median axis of the object holder is configured to be located in an area of the first sleeve which is configured to correspond to a front part of a user's the malleolus of the fibula or a rear part of a user's the malleolus of the tibia, equidistant from the centers of the malleoli of the tibia and fibula.

13. The footwear article as claimed in claim 1, further comprising an elasticated strip arranged on the footwear article above the object holder, the elasticated strip is reinforced to account for a weight of the held object within said object holder and is smaller in diameter than the first sleeve.

14. The footwear article as claimed in claim 3, further comprising an elasticated strip, which is smaller in diameter than the first sleeve, the elasticated strip is configured to be located in an area of the first sleeve which is between a top of the two malleoli of the user's leg and a base of the object holder.

15. The footwear article as claimed in claim 1, further comprising a distinctive marking to enable the user to identify whether the footwear article is for the left foot or the right foot.

16. The footwear article as claimed in claim 1 forms a part of a pair of footwear articles comprising a footwear article configured for the left foot and a footwear article configured for the right foot.

17. The footwear article as claimed in claim 1, wherein the footwear article is a sock or a stocking.

18. The footwear article as claimed in claim 3, wherein the footwear article is a sock or a stocking.

19. The footwear article as claimed in claim 1, wherein the object holder comprises a housing, a support or a strip.

* * * * *